US005401002A

United States Patent [19]

Major

[11] Patent Number: 5,401,002

[45] Date of Patent: Mar. 28, 1995

[54] BARB STIFFENING PROCESS AND PRODUCT

[76] Inventor: Daniel W. Major, 76 Benham Rd., Seymour, Conn. 06483

[21] Appl. No.: 85,597

[22] Filed: Jul. 1, 1993

[51] Int. Cl.[6] ..... B21F 25/00; E04H 17/04

[52] U.S. Cl. ..... 256/2; 256/6; 256/8

[58] Field of Search ..... 256/2, 3, 4, 5, 6, 7, 256/8

[56] References Cited

U.S. PATENT DOCUMENTS

| | | | |
|---|---|---|---|
| 466,748 | 1/1892 | Allis | 256/8 |
| 2,908,484 | 10/1959 | Uhl | 256/3 |
| 4,040,603 | 8/1977 | Mainiero | 256/8 |
| 4,509,726 | 4/1985 | Boggs et al. | 256/8 |
| 4,718,641 | 1/1988 | Mainiero | 256/8 |
| 4,818,972 | 4/1989 | Mainiero et al. | 256/8 |
| 4,844,422 | 7/1989 | Major | 256/8 |
| 4,887,796 | 12/1989 | Cano et al. | 256/2 |
| 5,074,529 | 12/1991 | Mainiero et al. | 256/8 |

*Primary Examiner*—Richard A. Bertsch

*Assistant Examiner*—Howard R. Richman

*Attorney, Agent, or Firm*—Bachman & LaPointe

[57] ABSTRACT

A barbed tape includes a central supporting portion and a plurality of barb clusters disposed at spaced apart locations along the central supporting portion, each barb cluster having first and second pairs of oppositely extending substantially planar barbs disposed on opposite edges of the central supporting portion and connected thereto, the barbs having a cross section which is at least partially arcuate, whereby the barbs are substantially stiffened against bending. A process for forming a barbed tape having stiffened barbs includes the steps of providing a barbed tape having a central supporting portion and a plurality of barb clusters disposed at spaced apart locations along the central supporting portion, each barb cluster having first and second pairs of oppositely extending substantially planar barbs disposed on opposite edges of the said supporting portion and connected thereto, and roll forming the barb clusters so as to provide the barbs with a cross section which is at least partially arcuate, whereby the barbs are substantially stiffened against bending.

11 Claims, 3 Drawing Sheets

BARB STIFFENING PROCESS AND PRODUCT

BACKGROUND OF THE INVENTION

The invention relates to a barbed tape and a process for forming a barbed tape wherein the barbs of the tape are stiffened against bending.

Barbed tape is widely used as an anti-personnel barrier in numerous private and government applications such as prison facilities, military installations, and the securing of private residences and the like. Such tape typically includes an elongated generally flat central support structure having clusters of barbs at spaced apart locations. Each cluster of barbs typically comprises a first pair of barbs extending from a root on one edge of the tape and a second pair of barbs extending from a root on the opposite edge of the tape. Each barb is a generally elongated planar structure having two generally opposed edges converging toward one another and meeting at a very sharp point. The barbs in each pair lie in a common plane, with points extending in generally opposite directions relative to one another.

The above described barbed tape is formed into a helical configuration such that the plane of the tape is aligned generally perpendicular to the axis of the helix. Thus, the points of the barbs extend in generally tangential directions relative to the helix, while the roots to which the pairs of barbs are joined extend generally in radially outward and inward directions relative to the helix.

Such a helical configuration of tape may be arranged along the tops of walls or barriers or at ground level so as to serve as a barrier to intruders.

Helical coils of barbed tape are deployed such that a person attempting to pass therethrough will contact at least a portion of the tape. This initial contact often will be with one or more of the closely spaced barbs on the tape, which are formed with sufficient sharpness to inflict a severe wound. This initial contact with the tape will also cause wavelike movements elsewhere in the helical tape causing other barbed clusters to be urged into contact with the intruder. Thus, even if the initial contact with the helical barbed tape is at a location spaced from a barbed cluster, this initial harmless contact is likely to urge other barbed clusters into the intruder.

One problem frequently encountered with the foregoing is that the barbs must be made of a relatively thick material to provide sufficient rigidity so that they do not merely bend rather than inflict the intended injury. However, such thick material results in added expense, provides a barb which is less sharp, and accelerates wear to stamping and die cutting machines used to make such tape.

U.S. Pat. No. 4,718,641 to Mainiero discloses a barbed tape wherein the barbs are reinforced with flanges, or stepped or embossed portions or the like. Such reinforcement provides the barbs with some degree of resistance to bending. However, the non-embossed portions of the barbs are still relatively susceptible to bending.

It is of course desirable to provide a barbed tape wherein the tape is made from a thin material so as to save on material costs, provide a sharper point to the barbs, and reduce wear on stamping and die cutting equipment and the like used for forming the tape, while barbs of the tape remain sufficiently resistant to bending.

It is therefore the principal object of the present invention to provide a barbed tape and a process for forming same wherein at least a substantial portion of the barb is stiffened, strengthened and/or work hardened so that a thinner material can be utilized to prepare the tape so as to provide a sharp barb while maintaining the desired rigidity or resistance to bending of the barb.

It is another object of the invention to provide a process for forming such a barbed tape wherein the use of a thinner material reduces wear on stamping and die cutting machinery and also reduces the overall material cost of the tape.

Other objects and advantages will appear hereinbelow.

SUMMARY OF THE INVENTION

The foregoing objects and advantages are readily attained by the present invention.

The invention is drawn to a barbed tape and a process for forming same wherein the tape has stiffened barbs wherein at least a substantial portion of the barb is stiffened and work hardened so as to provide a sharp, rigid barb on tape which is economically and efficiently prepared without excess wear on stamping and cutting or other forming machinery.

According to the invention, the barbed tape comprises a central supporting portion and a plurality of barb clusters disposed at spaced apart locations along said central supporting portion, each barb cluster comprising first and second pairs of oppositely extending substantially planar barbs disposed on opposite edges of said central supporting portion and connected thereto, said barbs having a cross section which is at least partially arcuate, whereby said barbs are substantially stiffened against bending.

The barbed tape of the invention is preferably formed according to the process comprising the steps of providing a barbed tape having a central supporting portion and a plurality of barb clusters disposed at spaced apart locations along said central supporting portion, each barb cluster comprising first and second pairs of oppositely extending substantially planar barbs disposed on opposite edges of said supporting portion and connected thereto, and roll forming said barb clusters so as to provide said barbs with an arcuate cross section whereby said barbs are substantially stiffened against bending.

Barb clusters may be roll formed one or more times or cycles, preferably in alternating directions of curvature, so that the material of same is work hardened.

BRIEF DESCRIPTION OF THE DRAWINGS

A detailed description of the preferred embodiments of the invention follows, with reference to the accompanying drawings, wherein.

DETAILED DESCRIPTION

The invention relates to a barbed tape having stiffened barbs which is suitable in numerous applications as an anti-personnel barrier.

Figure 1:
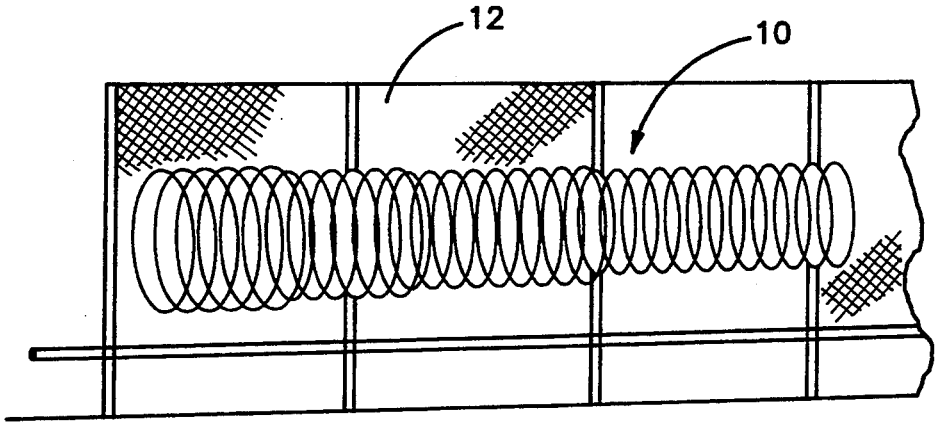
FIG. 1 illustrates a helical coil of barbed tape disposed along a fence.

FIG. 1 illustrates a typical use of such tape. As shown, the barbed tape is formed into a helical structure 10 which can then be positioned as desired, for example on a fence 12 as shown, to prohibit or inhibit the passage of intruders and the like. Typical uses include positioning the tape along fences or walls, perimeters of military installations or prison facilities and the like, and numerous other uses wherein an anti-personnel barrier is desired.

Figure 2:
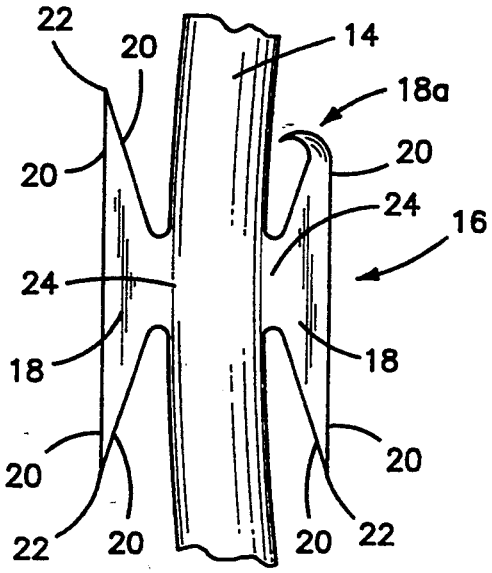
FIG-2 (PRIOR ART)
FIG. 2 illustrates a section of conventional barbed tape.

FIG. 2 illustrates a section of conventional barbed tape. As shown, the tape typically has a central supporting portion 14 upon which barb clusters 16 are disposed at spaced apart locations. For simplicity, FIG. 2 shows a portion of such tape having a single barb cluster 16. Of course, additional substantially identical barb clusters 16 are generally spaced along the entire length of the barbed tape. Each barb cluster 16 includes two pairs of oppositely extending barbs 18 disposed on opposite edges of central supporting portion 14. Each pair of barbs 18 is arranged substantially tangential to the surface of the helical structure, with one pair facing helically outward and one pair inward.

Figure 3:
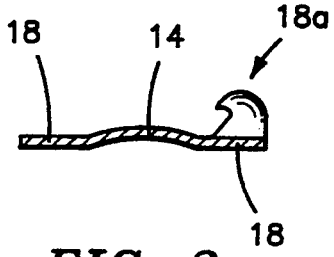
FIG-3 (PRIOR ART)
FIG. 3 is a cross section of the conventional barbed tape of FIG. 2.

Barbed tape is typically formed from a metallic material, and each barb 18 is formed by two edges 20 coming together at a point 22. Point 22 is intended to slash into an intruder attempting to cross a barrier equipped with the barbed tape. However, conventional tape having substantially flat barbs 18 is susceptible to bending as shown by bent barb 18*a*, which bending renders the barb 18*a* ineffective. (See also FIG. 3). The resistance of barbs 18 to bending can be increased by utilizing material having a larger thickness. However, such additional thickness reduces the sharpness of barbs 18, costs more as more material is required, and induces accelerated wear on parts of machinery used to stamp, die cut, or otherwise form the tape.

FIG. 2 also shows the connection of barbs 18 to central supporting portion 14 through root members 24. Such root members 24 are also susceptible to bending when a force is applied to barbs 18.

As set forth above, it is known to improve the resistance of barbs 18 to bending by providing flange structure (FIG. 4) or embossed portions (FIG. 5) on barbs 18.

Figure 4:
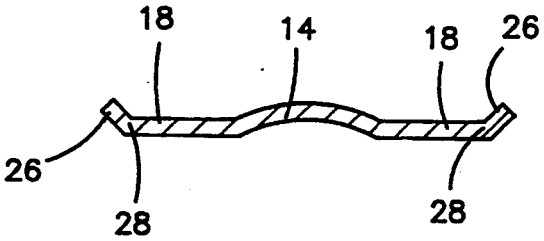
FIG-4 (PRIOR ART)
FIG. 4 illustrates a conventional flange-type barb reinforcement.

FIG. 4 is a section of a barb 18 having flanges 26 formed along edges of barbs 18. Flanges 26 help improve the rigidity of barb 18. However, flanges 26 only actually strengthen the barb 18 at the point 28 where flange 26 meets barb 18. The remaining portion of barb 18 is still subject to bending.

Figure 5:
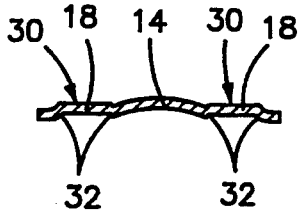
FIG-5 (PRIOR ART)
FIG. 5 illustrates a conventional embossed or stepped barb reinforcement.

FIG. 5 illustrates another known method of reinforcing barbs 18. A cross section of such a barbed tape is shown, wherein barbs 18 have embossed portions 30 which are stepped relative to the rest of barb 18 so as to provide stepped portions 32. Non-stepped portions of barb 18, however, are still subject to bending.

According to the invention, barbs are provided which have improved resistance against bending, thus allowing a thinner material to be used without sacrificing the rigidity of the barbs, and also reducing the wear on machinery used to form the tape.

Figure 6:
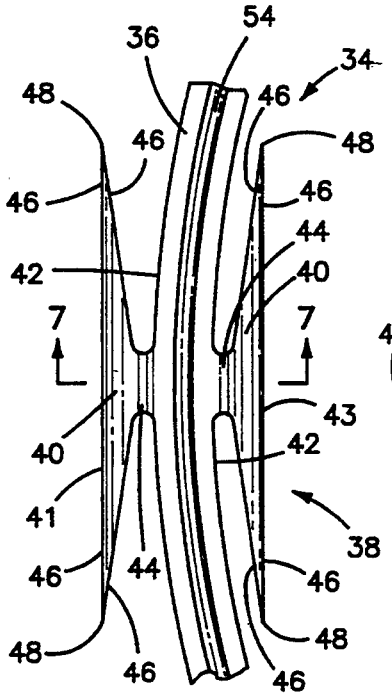
FIG. 6 illustrates a section of barbed tape having stiffened barbs according to the invention.

FIG. 6 illustrates a portion of barbed tape 34, according to the invention. As above, tape 34 includes a central supporting portion 36 having a plurality of barb clusters 38 disposed thereon at spaced apart locations. Each cluster includes two pairs of oppositely extending barbs 40, one pair being connected to each side or edge 42 of central supporting portion 36 through root members 44. Each barb 40 is formed so as to have two edges 46 coming together at a sharp point 48. Barbs 40 are typically substantially planar, although it is also known to offset the plane of barbs 40 relative to the plane of central supporting portion 36, so that the plane of barbs 40 intersects the plane of central supporting portion 36.

According to the invention, barbs 40 are provided with an at least partially arcuate cross section so as to provide enhanced structural stiffening against bending. Such a structure increases the area of the barb which resists bending, thereby strengthening barb 40 and allowing same to be made from a thinner material which, as set forth above, is desirable. Such cross section is preferably taken substantially normal to a longitudinal axis of central supporting portion 36, such as the section illustrated in FIG. 7. Of course, providing an arcuate or partially arcuate cross section wherein the cross section is taken in a direction other than substantially normal to central supporting portion 36 also provides enhanced stiffening of barbs 40. Such an embodiment is discussed below with reference to FIGS. 10 and 11.

Figure 7:
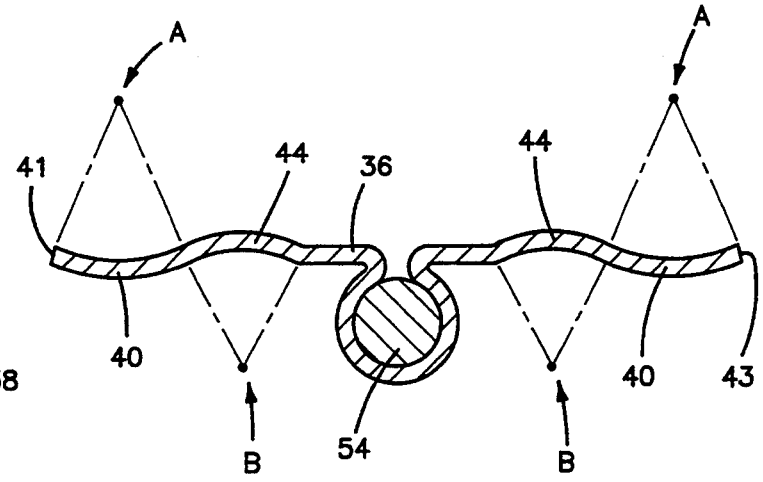
FIG. 7 is an enlarged cross section of the barbed tape of FIG. 6.

FIG. 7 is a section taken through a barb cluster 38 so as to illustrate the arcuate cross section of barbs 40. The arcuate cross section, in accordance with the invention, is preferably defined around an axis A which is substantially parallel to a longitudinal axis of barbs 40. Barbs 40 of each pair of barbs extend in opposite directions, preferably in substantially the same plane. Provision of the arcuate cross section as aforesaid helps to strengthen barbs 40 against bending out of the plane.

Also as shown in FIG. 7, root members 44 may be arcuate in cross section as well so as to strengthen same against bending. In this regard, roots 44 are preferably arcuate about an axis B which is substantially parallel to axis A discussed above. Further, the arcuate cross section of barbs 40 preferably has an opposite direction of curvature as compared to root members 44. This may be provided by forming the arcuate cross section of barbs 40 and the arcuate cross section of root members 44 so that axis A and axis B are on opposite sides of tape 34 as shown in FIG. 7.

Arcuate sections, in accordance with the invention, preferably have a radius of at least about 1/64 inch so that such arcuate cross sections are sufficiently curved to provide additional structural strength of barbs 40. Further, each arcuate section preferably covers an arc of between about 40° to 70°.

Figure 8:
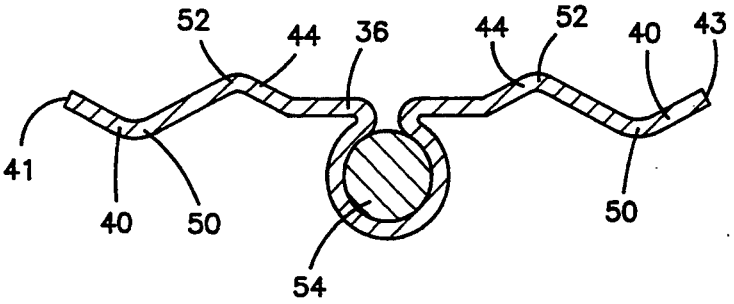
FIG. 8 is an enlarged cross section of an alternate embodiment of barbed tape having stiffened barbs according to the invention.

FIG. 7 illustrates a preferred embodiment of the invention wherein barbs 40 are entirely arcuate in cross section. Referring to FIG. 8, an alternate embodiment of the invention is illustrated wherein barbs 40 and root members 44 have a rounded-V-shaped cross section which has an arcuate vertex 50. Arcuate vertex 50 serves to provide barb 40 with improved structural resistance to bending. Root members 44 of the embodiment of FIG. 8 have an inverted rounded V shaped cross section, also having an arcuate vertex 52. Arcuate vertex 52 provides enhanced structural strength to root members 44.

It should be noted that the arrangement of arcuate portions of barbs 40 and roots 44 as set forth above are examples of preferred embodiments of the invention, and numerous other arrangements of arcuate cross sections could of course be implemented in accordance with the invention. For example, FIGS. 6 and 7 show a full cross section through central supporting portion 36 and a barb cluster 38 having four arcuate portions, one in each barb 40 and one in each root 44. In accordance with the invention, a different number of arcuate portions could of course be provided. For example, several arcuate portions could be formed in each barb. Alternatively arcuate portions could be formed in the barbs only, thereby providing as few as two arcuate portions. However, at least four arcuate portions as set out above are preferable.

The stiffening of barbs 40 and root members 44 with arcuate cross sections is further advantageous over flange or step reinforcements because reinforcing barbs with such sharp corners or angles requires a wider starting portion of tape. That is, in terms of width from one edge 41 of a barb 40 to the edge 43 of the other barb 40 of a barb cluster 38, reinforcement with corners provided by flanges and the like requires a greater width of starting material than an arcuately curved barb. Thus, barbs 40 stiffened according to the invention with arcuate portions possess a greater structural strength and can be made with a narrower width of starting material than barbs conventionally reinforced.

Tape according to the present invention may be provided with a thickness of less than about 0.03 inches, and preferably about 0.02 inches, while providing barbs 40 and root members 44 with excellent resistance to bending.

FIGS. 7 and 8 further illustrate another embodiment of the invention wherein central supporting portion 36 of tape 34 is formed around a support wire or member 54. Support member 54 serves to strengthen central supporting portion 36, and tape 34 generally, against undesirable bending which could otherwise interfere with or prevent the operation of barbed tape 34 as an anti-personnel barrier as desired. Central supporting portion 36 may be formed around support member 54 through any conventional means. Naturally, central supporting portion 36 may also be formed having the same cross section as tape 14 of the prior art (see FIGS. 3 and 5). Thus, central supporting portion 36 may be substantially flat, and may have an arcuate or partially arcuate cross section, or may be formed around additional supporting structure such as support member 54.

Figure 10:
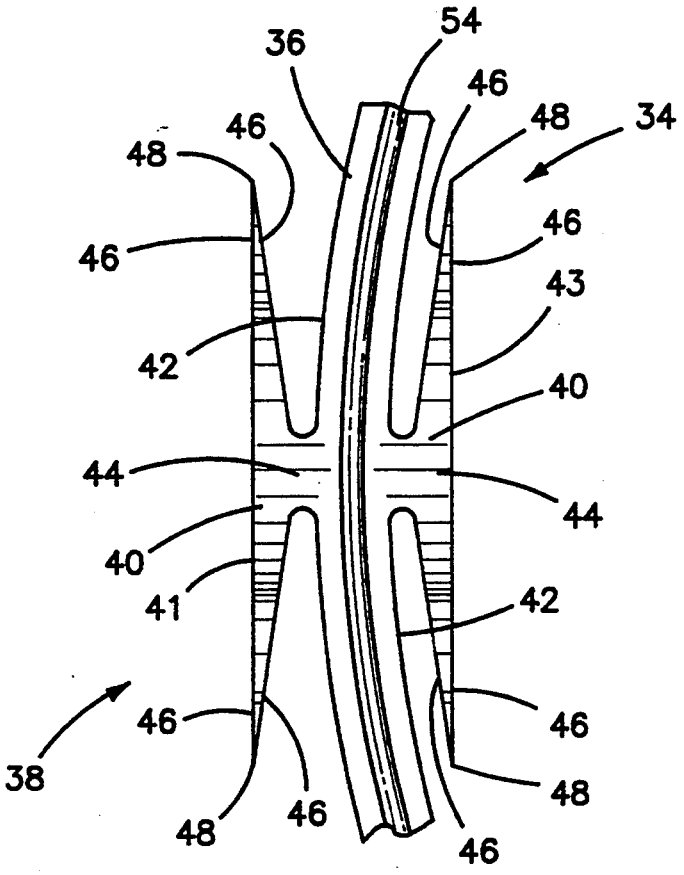
FIGS. 10 and 11 illustrate an alternate embodiment of the invention.
Figure 11:
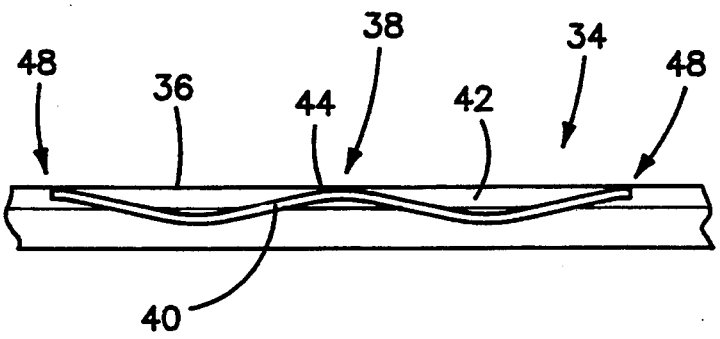

FIGS. 10 and 11 illustrate an alternate embodiment wherein barbs 40 and roots 44 are stiffened with arcuate sections or portions formed in a cross section taken substantially parallel to central supporting portion 36. In this embodiment, as illustrated in the side view of FIG. 11, barbs 40 are provided with a rippled or wave structure between points 48 of oppositely extending barbs 40, thereby strengthening barbs 40 against bending. Also as shown, the arcuate cross section may be extended through root members 44 to strengthen them as well.

In further accordance with the invention, a process is provided for forming barbs 40 and root members 44 with at least partially arcuate cross sections, as set forth above, wherein the barbs 40 and root members 44 are also work hardened while being provided with arcuate cross sections so as to provide additional resistance to bending.

Figure 9:
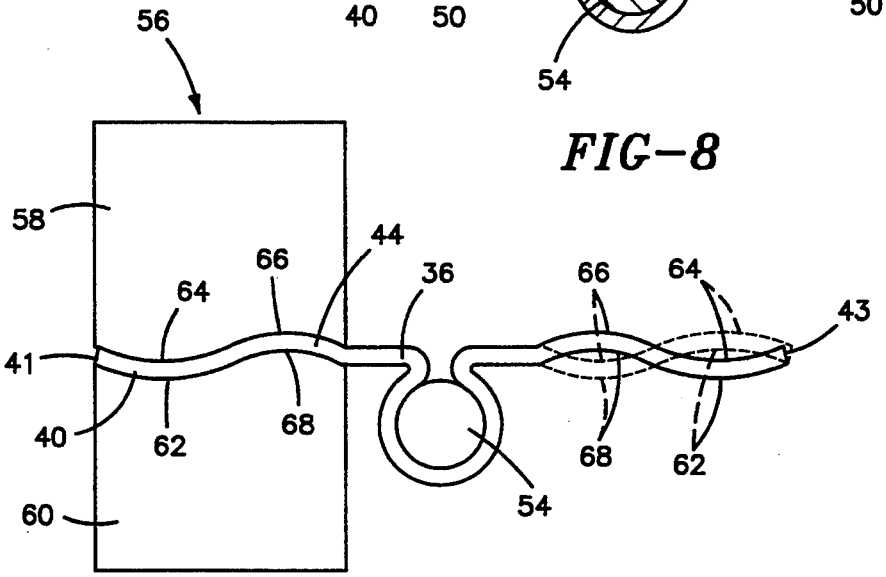
FIG. 9 schematically illustrates the roll forming of stiffened and work hardened barbed tape according to the present invention.

According to the invention, barbs 40 and root members 44 are provided with an arcuate cross section through a roll forming procedure. FIG. 9 schematically illustrates a roll forming apparatus 56 which may typically have mating sections 58, 60 between which barbs 40 and root members 44 can be passed so as to impart the desired arcuate shape. Such roll forming places one side 62 of barb 40 in tension and the other side 64 in compression. According to the invention, and also as schematically illustrated, barbs 40 and root members 44 are preferably passed through a number of roll forming cycles having operative surfaces which provide arcuate cross sections having opposite directions of curvature. In this manner, sides 62,64 of barbs 40 are alternatingly placed in tension and compression by succeeding roll forming cycles, as illustrated by the solid and dashed lines of the right hand portion of FIG. 9. Such alternating compression and tension serves to work harden the material of barbs 40 so as to materially enhance the already improved structural strength thereof. The number of roll forming cycles to be used differs based upon the thickness and characteristics of the material to be used. Typically, between about one to four cycles are suitable although, depending upon the material, any number of cycles may actually turn out to be ideal for optimum work hardening. Root members 44 may also suitably be roll formed in a similar manner to the roll forming of barbs 40, whereby sides 66, 68 of root members 44 are also alternatingly placed in tension and compression for a number of cycles to thereby work harden and strengthen root members 44.

The desired cross section of barbs 40 and root members 44 can of course be obtained, be it entirely arcuate, rounded-V-shaped, or the like, by providing an appropriately shaped operative surface on roll former 58. Further, the actual operative structure of roll former 58 is not critical and could suitably be any well known and conventionally available roll forming apparatus. The above-described cyclical work hardening may suitably be obtained by passing the tape through a series of roll formers 58 having operative surfaces of alternating opposite directions of curvature.

According to the invention, barbs 40 and root members 44 are structurally and/or materially strengthened and stiffened against bending, thereby allowing a thinner tape material to be used without sacrificing the effectiveness of the barbed tape for its intended purpose. The use of thinner material provides for a sharper point 48, reduced material costs, and reduced wear on machinery used in the manufacture of the tape including, for example, roll former 58 and any machinery used conventionally to provide the initial non-rolled barbed tape.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A barbed tape, comprising:

a central supporting portion; and a plurality of barb clusters disposed at spaced apart locations along said central supporting portion, each barb cluster comprising first and second pairs of oppositely extending substantially planar barbs disposed on opposite edges of said central supporting portion and connected thereto, said barbs having a cross section, which is at least partially arcuate, wherein said pairs of oppositely extending barbs are connected to said central supporting portion through root members, and wherein each root member has an arcuate cross section, wherein said arcuate cross section of said root members and said arcuate cross section of said pairs of barbs have opposite directions of curvature, whereby said barbs are substantially stiffened against bending.

2. A barbed tape according to claim 1, wherein said arcuate cross section of said barbs is taken through said barbs substantially normal to a longitudinal axis of said central supporting portion.

3. A barbed tape according to claim 1, wherein said arcuate cross section of said barbs is taken through said barbs substantially parallel to a longitudinal axis of said central supporting portion.

4. A barbed tape according to claim 1, wherein said barbs are entirely arcuate in cross section.

5. A barbed tape according to claim 1, wherein said arcuate cross sections have a radius of at least about 1/64 inch.

6. A barbed tape according to claim 1, wherein said arcuate cross section of said root members is taken through said root members substantially normal to a longitudinal axis of said central supporting portion.

7. A barbed tape according to claim 1, wherein said arcuate cross section of said root members is taken through said root members substantially parallel to a longitudinal axis of said central supporting portion.

8. A barbed tape according to claim 1, wherein said central supporting portion is a continuous elongated tape formed into a substantially helical shape and wherein a plane of said continuous elongated tape is substantially perpendicular to an axis of said substantially helical shape so that said tape has a helically outer edge and a helically inner edge.

9. A barbed tape according to claim 8, wherein said first and second pairs of oppositely extending barbs are disposed on said outer edge and said inner edge of said tape.

10. A barbed tape according to claim 1, wherein said central supporting portion is formed around a further supporting member whereby said central supporting portion is substantially reinforced against bending.

11. A barbed tape, comprising:

a central supporting portion; and a plurality of barb clusters disposed at spaced apart locations along said central supporting portion, each barb cluster comprising first and second pairs of oppositely extending substantially planar barbs disposed on opposite edges of said central supporting portion and connected thereto, said barbs having a cross section, which is at least partially arcuate, wherein said barbed tape has a full cross section taken through said central supporting portion and a barb cluster, and wherein said full cross section includes at least four arcuate portions, whereby said barbs are substantially stiffened against bending.

* * * * *